US007261155B1

(12) United States Patent
Ward et al.

(10) Patent No.: US 7,261,155 B1
(45) Date of Patent: Aug. 28, 2007

(54) CABLE SIDE-ENTRY SUB WITH GREASE INJECTION FLOW TUBES

(75) Inventors: Richard M. Ward, Conroe, TX (US); Ross E. Stevenson, Magnolia, TX (US)

(73) Assignee: Varco I/P, Houston, TX (US)

( * ) Notice: Subject to any disclaimer, the term of this patent is extended or adjusted under 35 U.S.C. 154(b) by 264 days.

(21) Appl. No.: 10/923,973

(22) Filed: Aug. 23, 2004

(51) Int. Cl.
*E21B 17/02* (2006.01)
*E21B 41/00* (2006.01)

(52) U.S. Cl. ..... 166/242.5; 166/117.5; 166/242.2; 166/380

(58) Field of Classification Search ..... 166/385, 166/380, 117.5, 242.2, 242.5; 277/330
See application file for complete search history.

(56) References Cited

U.S. PATENT DOCUMENTS 4,062,551 A * 12/1977 Base ..... 277/330
4,200,297 A * 4/1980 Tricon ..... 277/337
4,506,729 A * 3/1985 Davis et al. ..... 166/66.5
4,951,745 A 8/1990 Gentry et al.
6,732,805 B1 5/2004 Boyd
2001/0027879 A1* 10/2001 Runia ..... 175/50

* cited by examiner

*Primary Examiner*—Jennifer H Gay
(74) *Attorney, Agent, or Firm*—Law Office of Tim Cook P.C.

(57) ABSTRACT

An integrated side-entry sub with grease injection flow tubes is adapted for making up in a drill string and includes a port to receive a cable, such as a wire line. A first pedestal, mounted within a cutout of the side entry sub, provides entry for the cable into the entry port. The first pedestal receives a first flow tube, which couples to a lower connector manifold. The lower connector manifold further provides a grease injection port. A second flow tube, coupled to the lower connector manifold, runs to an upper connector manifold. The upper connector manifold further provides an grease return port, as well an the entry point for cable into the sub.

18 Claims, 5 Drawing Sheets

CABLE SIDE-ENTRY SUB WITH GREASE INJECTION FLOW TUBES

FIELD OF THE INVENTION

The present invention relates generally to the field of wire line instruments deployed through a drill string and, more particularly, to a tool adapted to be made up in a drill string which provides side entry of a cable in combination with grease injection flow tubes. This tool provides a pressure seal on a braided wire line that is being pumped down hole.

BACKGROUND OF THE INVENTION

The tool of the present invention provides an external access port for wire line that is attached to a bottom hole assembly (BHA). It is common practice in oil and gas exploration and production to provide instruments down hole through a drill string. The instruments are included in the bottom hole assembly which is supported in the drill string by a cable or wire line which is inserted into short length of drill string as a distinct sub or tool. For known side entry tools, a sealing and lubricating assembly is often temporarily attached to the side entry port while the BHA is pumped down through the drill string. Then, when is time to make up the side entry tool into the drill string, the sealing and lubrication assembly is removed because it presents a profile that is tool large to fit into the hole.

The cable is typically sealed, in the absence of the sealing and lubrication assembly, with a rubber pack off. The amount of sealing pressure that can be exerted against the cable running through the pack off can be adjusted by adjusting a threaded follower. However, applying too much sealing pressure results in excessive wear as the cable is drawn through the tool, or the cable cannot run into the tool. Too little pressure means that the annulus between the cable and the rubber pack off leaks when subjected to operating pressure, typically 3,000 psi or even more. Stated another way, known side entry subs only have a rubber pack off and a pack off nut located at the outside of the entry hole. If the pack off nut is screwed in enough to energize the rubber pack off, it will clamp the wire line enough to stop it from being pumped down hole. Also, there is usually some leakage around the wire line, as the rubber pack off cannot completely seal on the braided wire line. If the rubber pack off is not energized, pump-down fluid exits the entry port causing safety and environmental concerns and tool damage due to erosion.

Thus, there remains a need for a side entry sub with an integrated the sealing and lubricating assembly. The present invention is directed to fulfilling this need in the art.

SUMMARY OF THE INVENTION

The tool of the present invention addresses these and other needs in the art by providing an integrated side entry sub with grease injection flow tubes. The side entry sub, adapted for making up in a drill string, includes a port to receive a cable, such as a wire line. A first pedestal, mounted within a cutout of the side entry sub, provides entry for the cable into the entry port. The first pedestal receives a first flow tube, which couples to a lower connector manifold. The lower connector manifold further provides a grease injection port. A second flow tube, coupled to the lower connector manifold, runs to an upper connector manifold. The upper connector manifold further provides an grease return port, as well an the entry point for cable into the sub.

Positioned above the upper connector manifold is a cable clamp to secure the cable to the sub. The cable clamp, the flow tubes, and the upper and lower connector manifolds all fit within the cutout, so that the effective outside diameter of the sub is substantially the same as the drill string into which the sub is fitted.

In operation, the wire line is first run into the tool through the entry port and then made up to the BHA. The cable side entry sub (CSES) is then connected to the drill string. A flow line is then connected to the top of the CSES. The BHA is then pumped down hole.

As the wire line is pumped down hole, grease is injected under pressure into the grease injection port in the lower connector manifold. The grease forms a pressure barrier around the wire line. Grease that flows up through the second flow tube exits the upper connector through the grease return port in the upper connector manifold and is collected in a safe container.

When the BHA has been run in to a desired depth, the grease entry and return lines are disconnected from the connector manifolds and the ports are plugged. The cable clamp is attached to the wire line to keep it from moving in relation to the CSES and the pack off nut energizes the rubber pack off to affect the seal around the wire line. The CSES can then be run down hole with the wire line on the outside of the tool string.

If the BHA becomes stuck, tension can be applied to the wire line, which will shear a shear screw in the cable clamp and allow the cable clamp to become disengaged from the wire line. The wire line can then be pulled out of the BHA and completely out of the hole via the entry port on the CSES. When the wire line exits the entry port, a flapper valve automatically closes and seals the entry port.

These and other features and advantages of this invention will be readily apparent to those skilled in the art.

BRIEF DESCRIPTION OF THE DRAWINGS

So that the manner in which the above recited features, advantages and objects of the present invention are attained and can be understood in detail, more particular description of the invention, briefly summarized above, may be had by reference to embodiments thereof which are illustrated in the appended drawings.

DETAILED DESCRIPTION OF A PREFERRED EMBODIMENT

Figure 1:
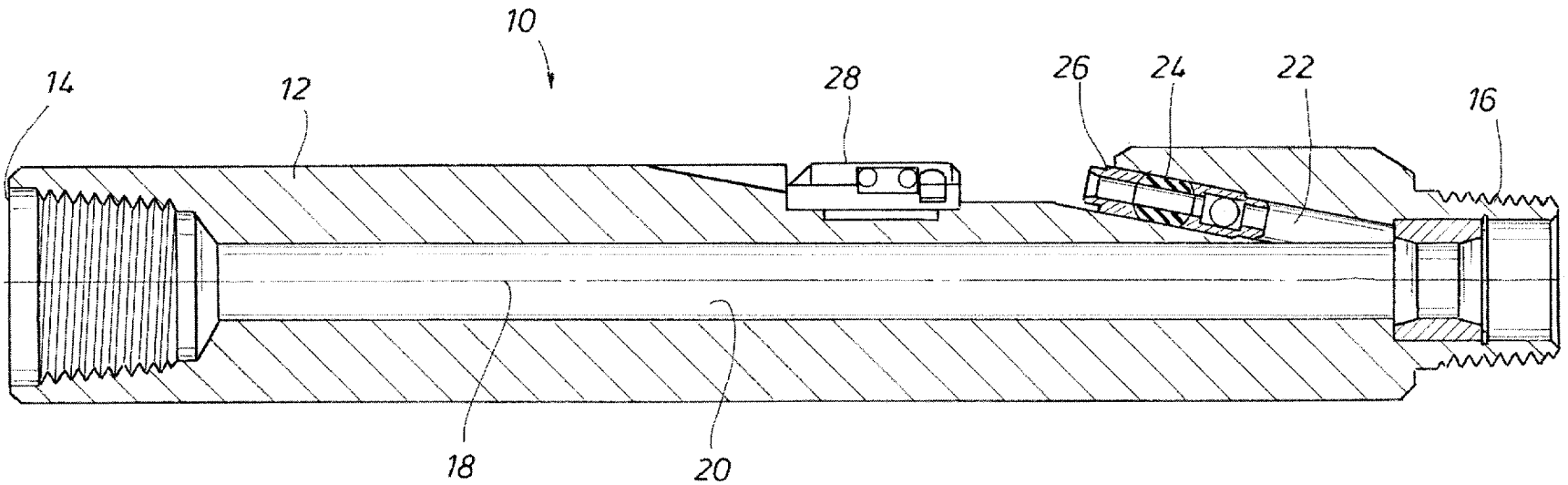
FIG. 1 (PRIOR ART)
FIG. 1 is a side section view of a known side entry sub.

So that the features of the present invention can be more readily understood, a known side entry sub 10 is depicted in FIG. 1. The sub 10 comprises a short length of drill pipe 12 with a conventional threaded box end 14 as a convention threaded pin end 16 to allow the sub to be made up into a drill string, all oriented along an axis 18 with the down hole end to the right as seen in FIG. 1. A coaxial flow channel 20 directs drilling fluid through the sub and carries the bottom hole assembly as it is pumped down hole.

A side entry port 22 provides access for a wire line cable (not shown) into the flow channel 20. A seal around the wire line cable is provided by a rubber pack off 24 which is energized by a pack off nut 26. The wire line cable is then run through a cable clamp 28 in the conventional manner. The only seal provided around the wire cable is thus the rubber pack off, which is notorious for leaking.

Figure 2:
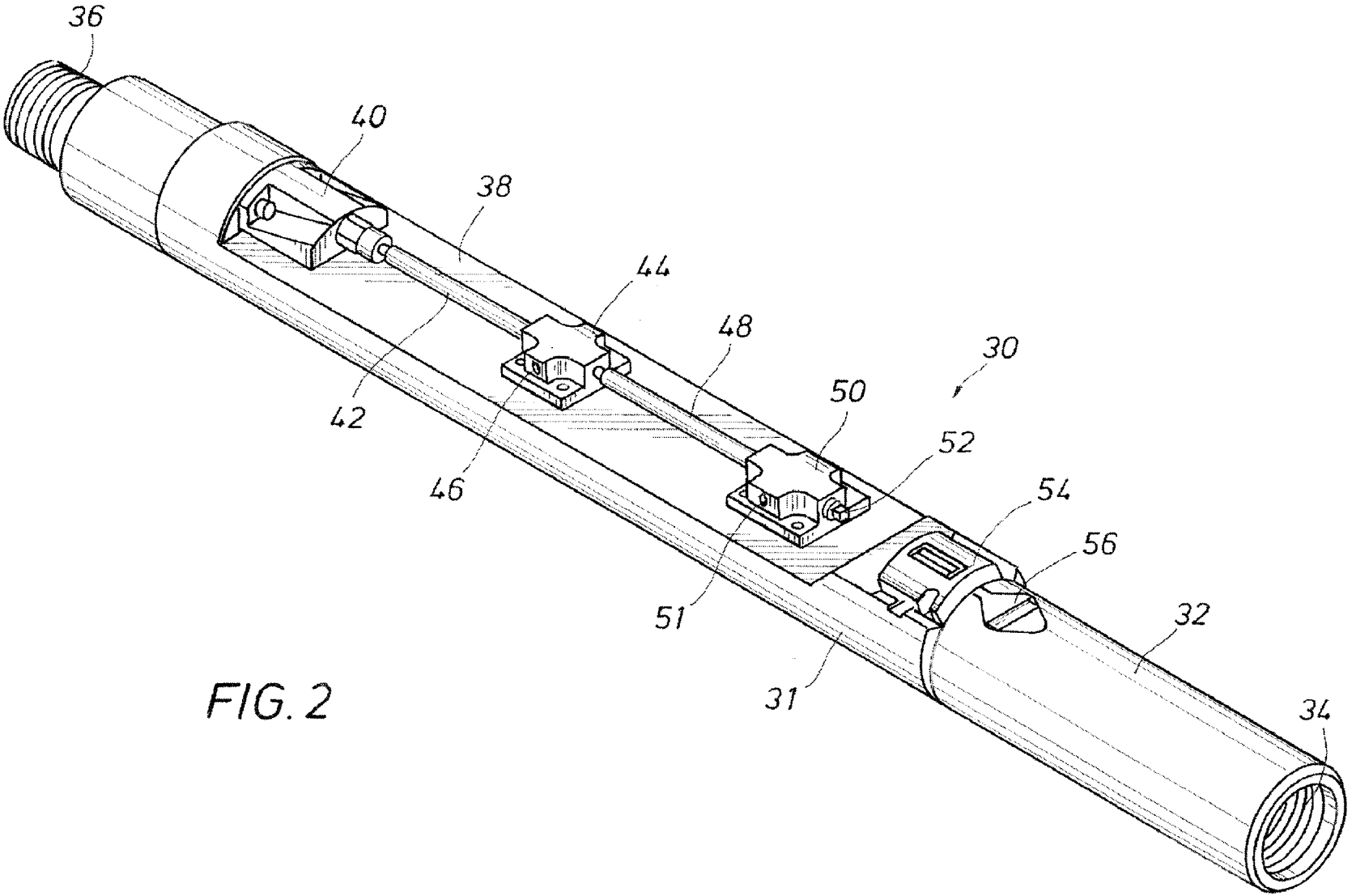
FIG. 2 is a perspective view of a side entry sub of the present invention.

The present invention solves this drawback in the art by providing a grease seal around the wire line cable as the sub is run into the drill hole. A perspective view of such a side-entry sub 30 is shown in FIG. 2, with the down hole end of the sub to the left as shown in the drawing figure. The sub 30 comprises a short length of drill pipe 32 comprising a tool body 31 with a box end 34 and a pin end 36 as before. The drill pipe 32 has a cutout 38 formed therein so that the elements secured to the sub in the cutout 38 project a profile that is substantially the same as the diameter of the drill pipe.

A wire line entry manifold 40 directs the wire line into an entry port, shown and described below in greater detail. A first flow tube 42 is joined to the entry manifold at its lower end and to a lower connector manifold 44 at its upper end. The lower connector manifold 44 also provides a grease injection port 46. A second flow tube 48 extends above the lower connector manifold to an upper connector manifold 50. The upper connector manifold 50 provides a grease return port 51 and an opening 52 to receive a wire line cable. The wire line cable is secured by a cable clamp 54 and retained in alignment along the body of the sub by a guide 56.

Figure 3:
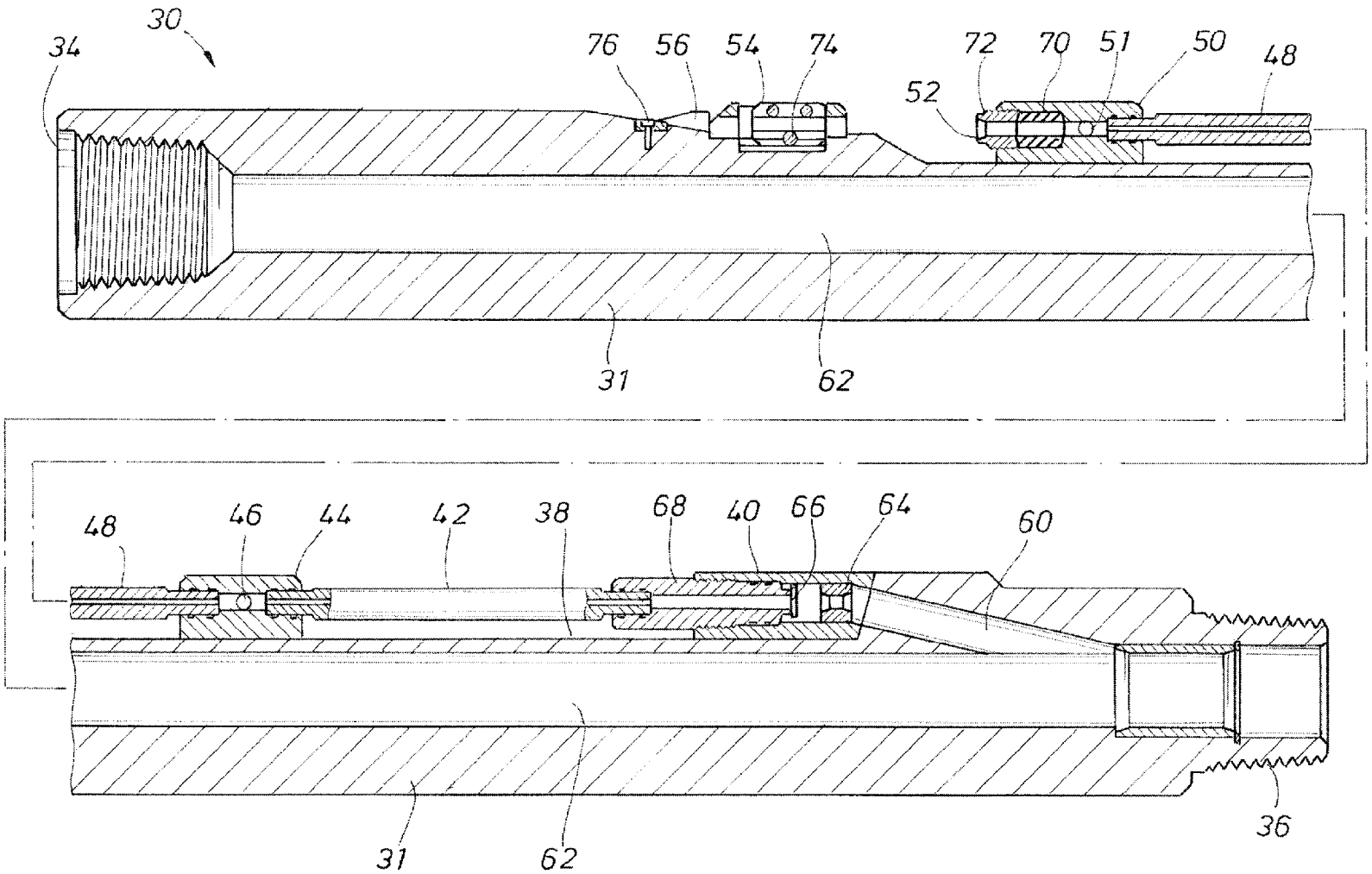
FIG. 3 is a side section view of the side entry sub of the invention taken along the section lines 3-3 of FIG. 4.
Figure 4:
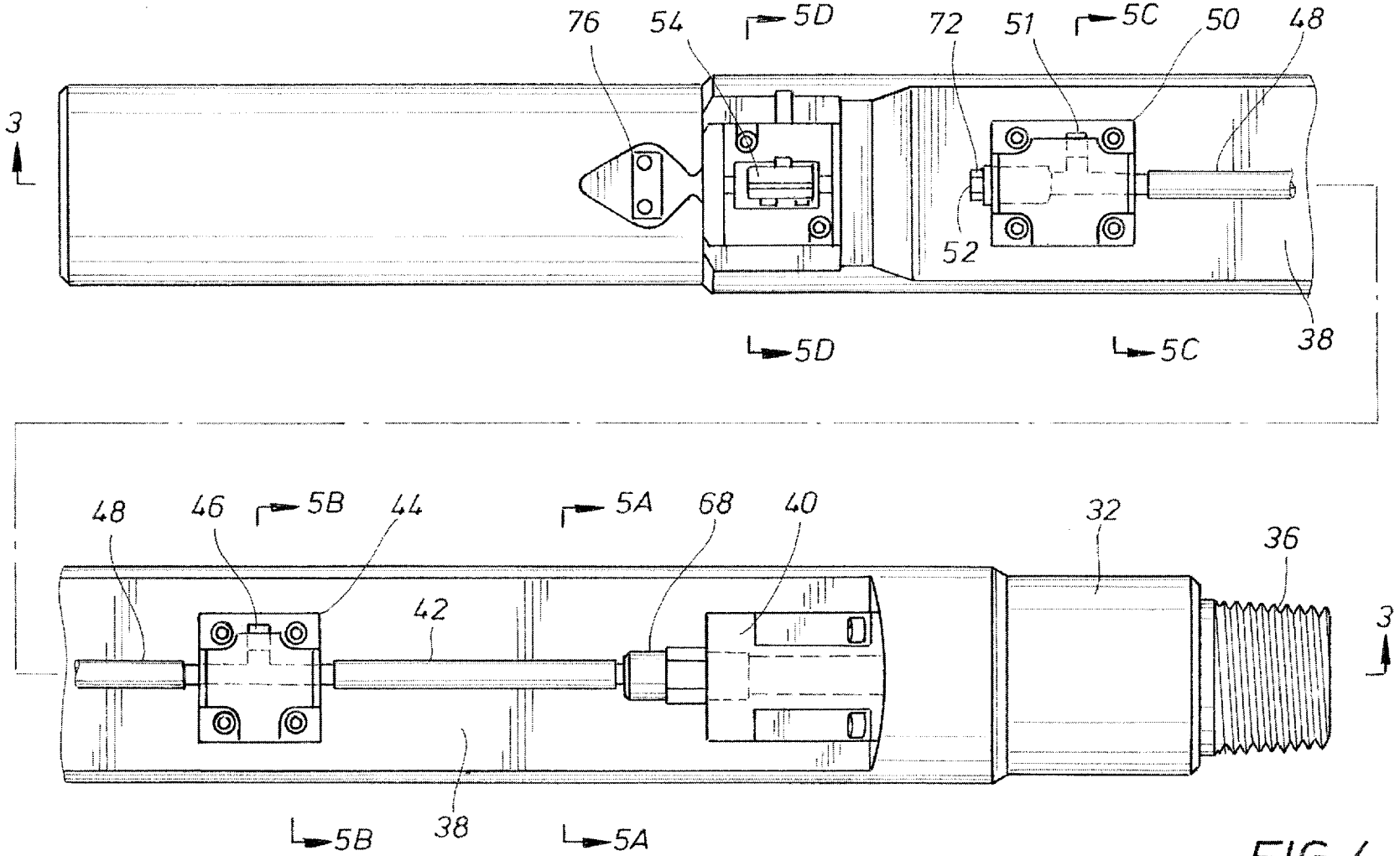
FIG. 4 is a top view of the side entry sub.
Figure 5A:
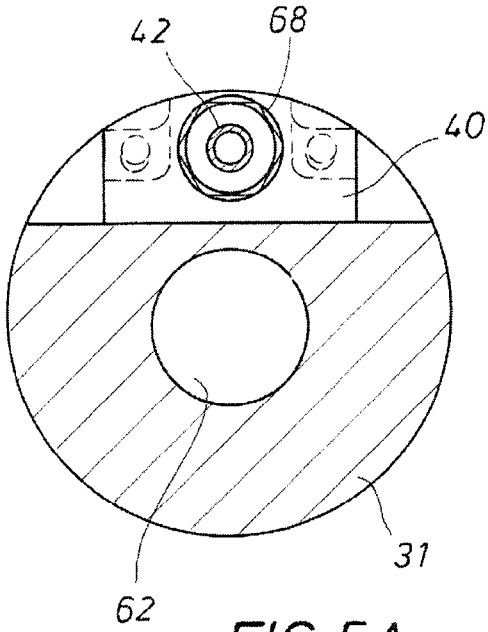
FIG. 5A is a section view of the side entry sub at section 5A-5A in FIG. 4.
Figure 5B:
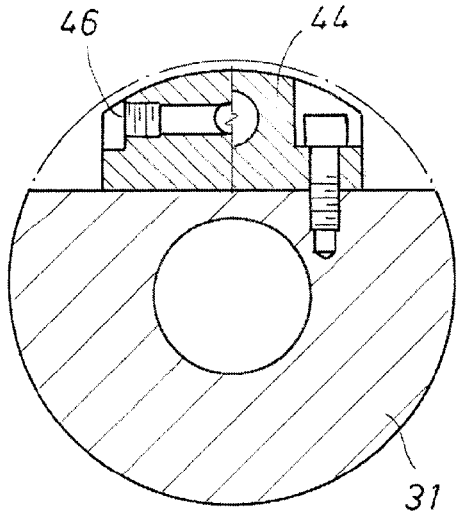
FIG. 5B is a section view of the side entry sub at section 5B-5B in FIG. 4.
Figure 5C:
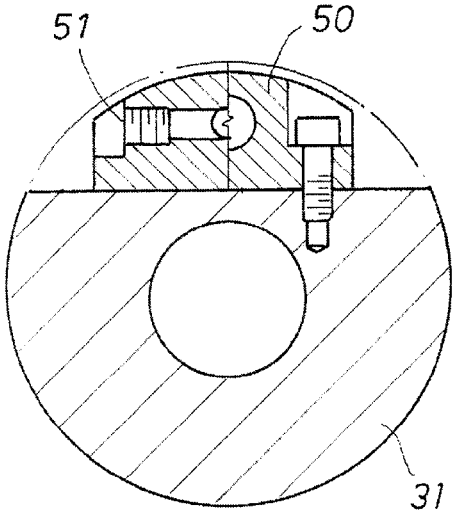
FIG. 5C is a section view of the side entry sub at section 5C-5C in FIG. 4.
Figure 5D:
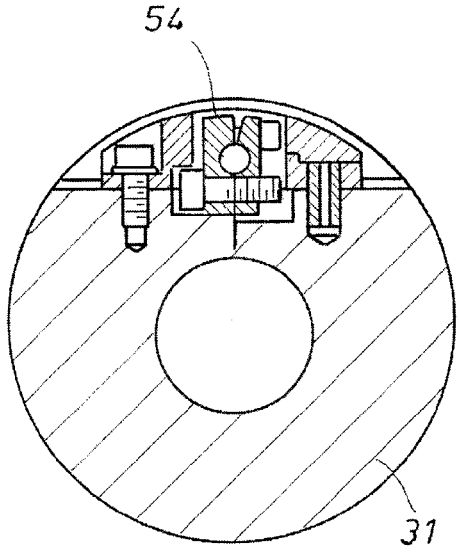
FIG. 5D is a section view of the side entry sub at section 5D-5D in FIG. 4.

FIG. 3 provides greater detail of the various components of the sub 30 of this invention by showing a side view in section. In FIG. 3, the down hole threaded pin 36 is shown to the right and the up hole box 34 is shown to the left in the drawing figure. An entry port 60 provides access into a drilling fluid flow channel 62. The wire line entry manifold 40 directs the wire line into the entry port 60 and is positioned in abutting engagement with the tool body 31 within the cutout 38. Within the wire line entry manifold 40 close to the opening of the entry port 60 is a wear bushing 64 to receive the abrasion of the cable running through the tool. Also within the wire line entry manifold is a flapper valve 66 to seal off the entry port in the event that the cable is withdrawn from the tool.

Extending out from the wire line entry manifold 40 is a follower 68. The follower threads into the wire line entry manifold with a hex surface and receives the down hole end of the first flow tube 42. The other end of the first flow tube, i.e. the up hole end, inserts into the lower connector manifold 44. The lower connector manifold 44 provides the grease injection port 46. Grease injected into the port 46 flows down (i.e. to the right in FIG. 3) and up (to the left), thereby providing a seal (as well as lubrication) around the cable running through the flow tubes.

The second flow tube 48 extends upward from the lower connector manifold 44 to the upper connector manifold 50. The upper connector manifold 50 provides the grease return port 51. The upper connector manifold 50 also includes a rubber pack off 70 and an adjustable pack off nut 72 to seal around the cable as it exits the tool. When the tool is made up to a drill string and is being run down hole, the cable exiting the tool is retained within the cable clamp 54 which is held to the tool with a shear pin 74. For pump down operations, the cable is allowed to freely run into the flow tubes. From the cable clamp, the cable passes through a guide 56 and over a wear pad 76.

Further details of the tool are provided in FIGS. 4 and 5A through 5D. Note that, as before, the pin end 36 is shown to the right and the box end 34 is shown to the left. The wire line cable goes through the wire line entry manifold 40 through the follower 68 and into the first flow tube 42, all within the cutout 38. (See also FIG. 5A.) The cable then passes through the lower connector manifold 44 where it passes by the grease injection port 46. (See also FIG. 5B.) Grease injected into the grease injection port seals and lubricates the cable, the flows to the right and left within the first and second flow tubes. The cable then passes through the second flow tube 48 and into the upper connector manifold 50. (See also FIG. 5C.) The upper connector manifold 50 provides the grease return port 51 and the opening 52 to receive a wire line cable. The opening is defined by the rubber pack off 70 and the adjustable pack off nut 72. Finally, the cable is secured by the cable clamp 54 and it then passes over the wear pad 76.

An important aspect of this cable side-entry sub (CSES) is the flow tubes that are attached to the tool. This allows the entire assembly to be run down hole. Tests have shown that the grease barrier and the rubber pack off can effectively seal on the braided wire line. This is a vast improvement over existing CSES from a safety as well as environmental aspect.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

We claim:

1. A cable side-entry sub for carrying a bottom-hole assembly through a drill string the sub comprising:

a. an axially oriented sub body having an effective outside diameter and defining a co-axial flow channel and a cutout defining a reduced diameter region in the sub body;

b. an entry port through the sub body and into the flow channel;

c. a grease injection seal in the cutout and adjoining the entry port, the grease injection seal fitting within the effective outside diameter of the sub body, wherein the grease injection seal comprises:

i. a first flow tube in communication with the entry port;

ii. a lower connector manifold coupled to the first flow tube, the lower connector manifold defining a grease injection port;

iii. a second flow tube coupled to the lower connector manifold; and iv. upper connector manifold coupled to the second flow tube, the upper connector manifold defining a grease return port.

2. The cable side-entry sub of claim 1, further comprising a wire line entry manifold between the first flow tube and the entry port.

3. The cable side-entry sub of claim 2, further comprising a follower in the wire line entry manifold to couple the first flow tube to the wire line entry manifold.

4. The cable side-entry sub of claim 2, further comprising a flapper valve in the wire line entry manifold.

5. The cable side-entry sub of claim 1, further comprising a rubber pack off and an adjustable pack off nut in the upper connector manifold.

6. The cable side-entry sub of claim 1, further comprising a cable clamp axially above the upper connector manifold.

7. The cable side-entry sub of claim 6, wherein the cable clamp fits within the effective outside diameter of the sub body.

8. The cable side-entry sub of claim 1, further comprising a wear pad axially above the grease injection seal.

9. The cable side-entry sub of claim 1, further comprising a wire line cable guide axially above the grease injection seal.

10. A cable side-entry sub for carrying a bottom-hole assembly through a drill string, the sub comprising:

a. an axially oriented sub body having an effective outside diameter and defining a co-axial flow channel and a cutout defining a reduced diameter region in the sub body;

b. an entry port through the sub body and into the flow channel;

c. a grease injection seal in the cutout and adjoining the entry port, the grease injection seal fitting within the effective outside diameter of the sub body; and d. a wear pad axially above the grease injection seal.

11. The cable side-entry sub of claim 10, wherein the grease injection seal comprises:

a. a first flow tube in communication with the entry port;

b. a lower connector manifold coupled to the first flow tube, the lower connector manifold defining a grease injection port;

c. a second flow tube coupled to the lower connector manifold; and d. upper connector manifold coupled to the second flow tube, the upper connector manifold defining a grease return port.

12. The cable side-entry sub of claim 11, further comprising a wire line entry manifold between the first flow tube and the entry port.

13. The cable side-entry sub of claim 12, further comprising a follower in the wire line entry manifold to couple the first flow tube to the wire line entry manifold.

14. The cable side-entry sub of claim 11, further comprising a rubber pack off and an adjustable pack off nut in the upper connector manifold.

15. The cable side-entry sub of claim 11, further comprising a cable clamp axially above the upper connector manifold.

16. The cable side-entry sub of claim 15, wherein the cable clamp fits within the effective outside diameter of the sub body.

17. The cable side-entry sub of claim 12, further comprising a flapper valve in the wire line entry manifold.

18. A cable side-entry sub for carrying a bottom-hole assembly through a drill string, the sub comprising:

a. an axially oriented sub body having an effective outside diameter and defining a co-axial flow channel and a cutout defining a reduced diameter region in the sub body;

b. an entry port through the sub body and into the flow channel;

c. a grease injection seal in the cutout and adjoining the entry port, the grease injection seal fitting within the effective outside diameter of the sub body, wherein the grease injection seal comprises:

i. a first flow tube in communication with the entry port;

ii. a lower connector manifold coupled to the first flow tube, the lower connector manifold defining a grease injection port;

iii. a second flow tube coupled to the lower connector manifold; and iv. upper connector manifold coupled to the second flow tube, the upper connector manifold defining a grease return port; and d. a wear pad axially above the grease injection seal.

* * * * *